United States Patent [19]

Yamazaki et al.

[11] 4,415,620

[45] Nov. 15, 1983

[54] MAT BASE PLATE

[75] Inventors: Ken Yamazaki, Hyogo; Yosuke Yamamoto, Osaka; Takehisa Kinoyama, Osaka; Kinichi Sasagawa, Osaka, all of Japan

[73] Assignee: Duskin Franchise Kabushiki Kaisha, Osaka, Japan

[21] Appl. No.: 157,078

[22] Filed: Jun. 6, 1980

[30] Foreign Application Priority Data

Oct. 11, 1979 [JP] Japan ..... 54-140678[U]
Oct. 11, 1979 [JP] Japan ..... 54-140679[U]
Oct. 11, 1979 [JP] Japan ..... 54-140680[U]

[51] Int. Cl.[3] ..... A47L 23/22; B32B 7/06

[52] U.S. Cl. ..... 428/157; 15/216; 52/181; 428/81; 428/163; 428/167

[58] Field of Search ..... 428/13, 14, 77–79, 428/81–83, 95, 157, 163, 167, 192; D6/209, 218, 219; 52/660–664, 177, 181; 15/215–217

[56] References Cited

U.S. PATENT DOCUMENTS

| | | | |
|---|---|---|---|
| D. 194,450 | 1/1963 | Kraines | D6/209 |
| 2,919,456 | 1/1960 | Spivey | 15/215 |
| 3,435,480 | 4/1969 | Mann | 15/215 |
| 4,012,544 | 3/1977 | Richards | 428/95 |
| 4,107,811 | 8/1978 | Imsande | 15/215 |
| 4,143,194 | 3/1979 | Wihksne | 15/215 |

*Primary Examiner*—John E. Kittle
*Attorney, Agent, or Firm*—Cushman, Darby & Cushman

[57] ABSTRACT

The mat base plate which is intended for use as a substrate for a door mat includes an outer peripheral rim, a plurality of concentric annular steps from the outer peripheral rim inwardly and downwardly and a central well to provide an aesthetic appearance for the plate/-plate combination even when a shrunken mat is placed on the plate.

17 Claims, 20 Drawing Figures

MAT BASE PLATE

BACKGROUND OF THE INVENTION

1. Field of the Invention

This invention relates to a mat base plate and more particularly to a mat base plate which provides an aesthetic appearance even with a mat which has been washed and cleaned.

2. Description of the Prior Art

A mat s indispensable to be placed in front of an entrance of a house so as to remove dust from shoes to that the dust is not taken into the house. A carpet having upright fibers is usually used for a mat and sometimes is placed on a mat base plate made from synthetic rubber, synthetic resin, etc., and then detachably secured thereon by means of convenient fastners, such as velcro hook and fleece fasteners, etc.

If the mat is washed and cleaned ater the passage of a certain time and shrinks because of such cleaning the conventional mat/mat base plate combination provides an inaesthetic view. The shrinkage of the mat is easily noticeable at a glance because of the gap created between the usual single step peripheral rim of the base plate and the shrunken mat.

SUMMARY OF THE INVENTION

To overcome such drawback of the prior art, this invention provides a mat base plate which provides an aesthetic view, even when a mat shrunken after cleanings is placed thereon, hiding such shrinkage.

One object of this invention is to provide a mat base plate having a rim with a plurality of steps in a slant slope adjoining the plate outer periphery. Another object of this invention is to provide a mat base plate having a plurality of ribs or grooves on the inner slope of the rim and a plurality of steps on the outer slope of the rim.

Still another object of this invention is to provide a mat base plate having a plurality of ribs or grooves on the inner slope of the outer marginal rib.

BRIEF DESCRIPTION OF THE ACCOMPANYING DRAWINGS

DESCRIPTION OF THE PREFERRED EMBODIMENTS

Now, the preferred embodiments of this invention will be hereinafter discussed with reference to the accompanying drawings.

The mat base plate 1 is made from synthetic rubber, synthetic resin and similar other materials in a flat sheet form with a plurality of annular steps 2 bordering the outer periphery of the plate, and a central concave portion or well 3 surrounded by the steps 2, a mat being placed within the well 3, supported on the well floor.

The steps 2 are formed of stairs 6*a* through 6*e* from the apex or ridge 5 progressing concentrically outwards and downwards from the center of the plate. Provided concentrically inwardly of the apical ridge 5 are a plurality of steps 7*a* through 7*d* progressing inwardly and downwardly to the floor of the well. The pitch of the steps is so provided that the steps outside the apical ridge are small and those inside are large, but it may be of course acceptable that both pitches be the same.

Figure 1:
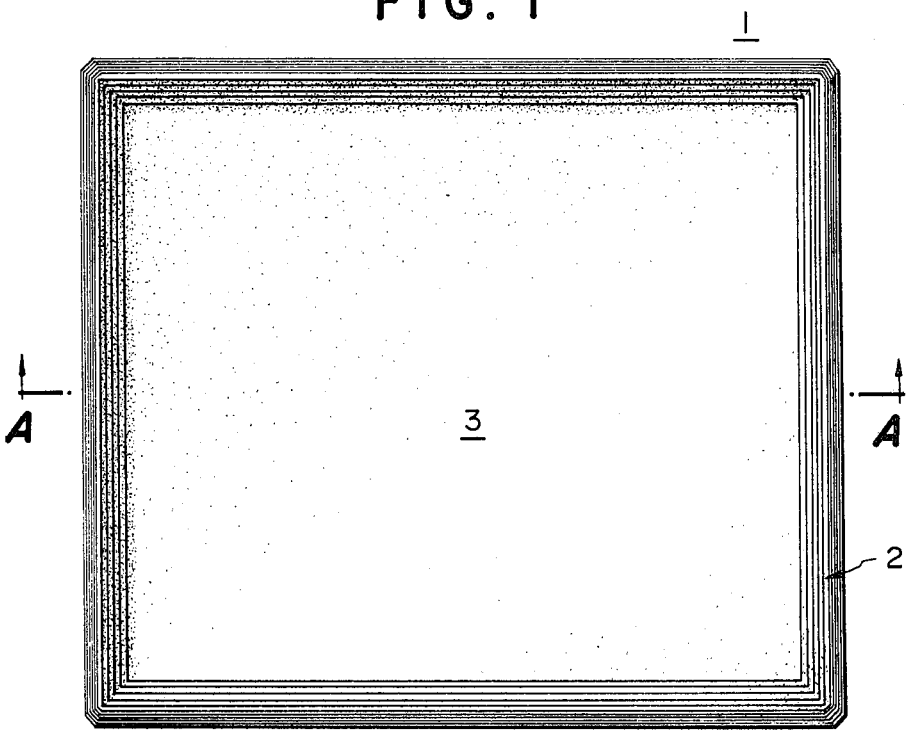
FIG. 1 is a plan view of the base plate according to a first embodiment.
Figure 2:
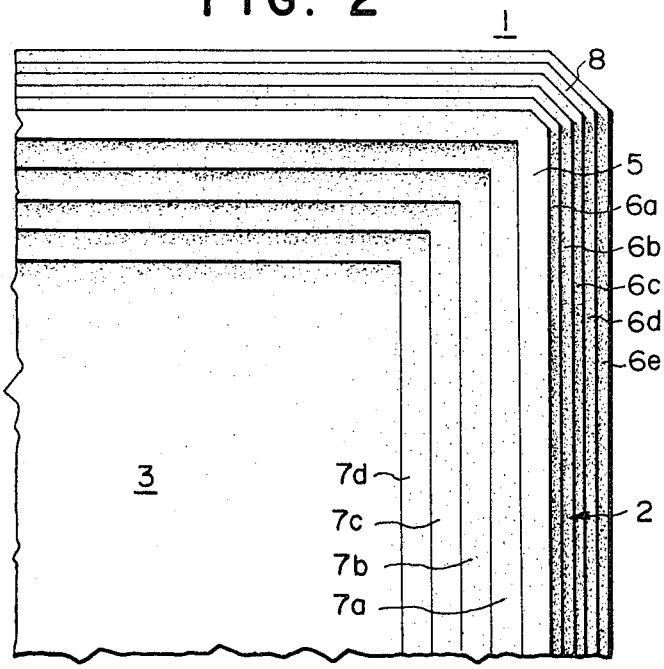
FIG. 2 is a partial enlarged plan view.
Figure 3:
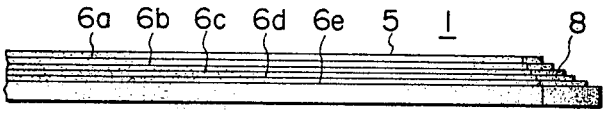
FIG. 3 is a partial enlarged side view.
Figure 4:
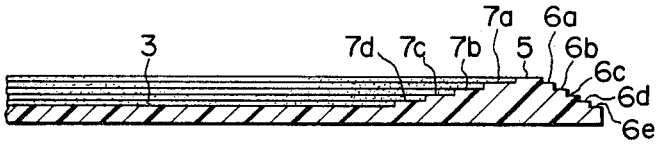
FIG. 4 is a partial enlarged cross section taken along line A—A in FIG. 1.

The corners of the steps at the corners of the mat base plate are not formed to meet at a sharp angle, but are chamfered corners as shown at 8. in FIG. 2.

Figure 5:
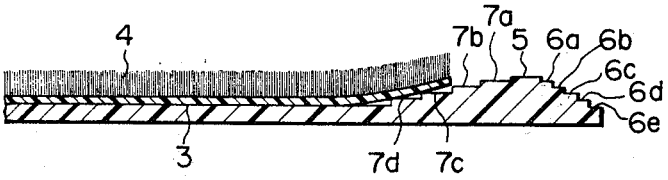
FIG. 5 and FIG. 6 are enlarged explanatory cross sectional views showing how the plate may be used in combination with a door mat.

In use, a new mat 4 is placed within and on the well 3 of the plate 1. Its outer peripheral region rests on the second to uppermost step 7*c* among the steps 7*a*–7*d*, for example, with the step 7*b* circumscribing at its edge. However, there is no risk that a person will be tripped by the edge of mat, since the mat is placed at a lower position than the apical ridge 5, as shown in FIG. 5.

Figure 6:
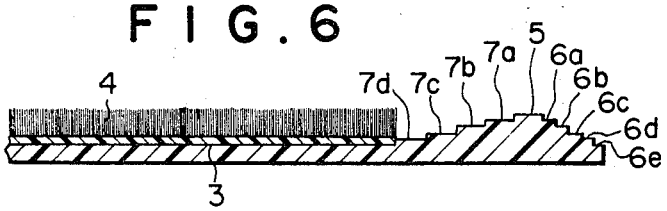
Figure 7:
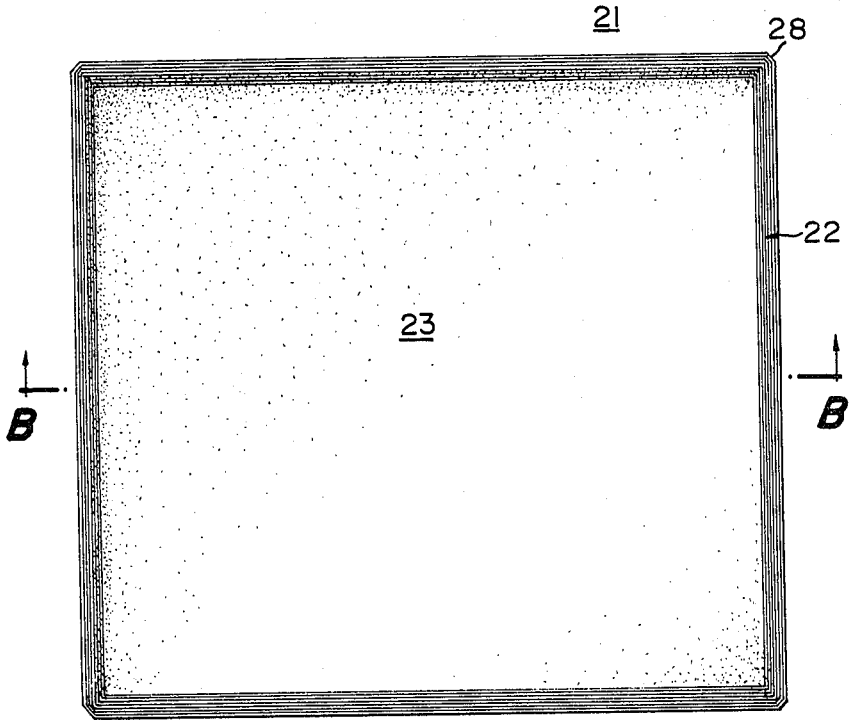
FIG. 7 is a plan view of a second embodiment of this invention.
Figure 9:
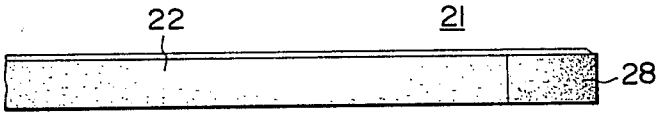
FIG. 9 is a partial enlarged side view.
Figure 10:
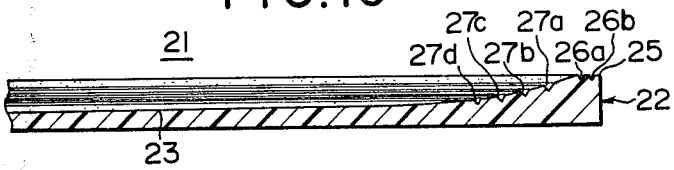
FIG. 10 is a partial enlarged cross section taken along line B—B in FIG. 7.
Figure 11:
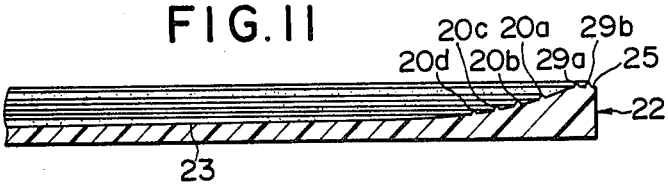
FIG. 11 is a partial enlarged cross section showing a modification of the second embodiment.

When at mat which has been cleaned and has, as a result, shrunk is placed on the plate, its outer ridge rests at innerside of the step 7*d* as shown in FIG. 6.

Upon viewing the mat from the above, the mat is surrounded by a plurality of the steps 7*a*–7*d*. In this connection, there is no gap around the mat as there is when using prior art mat base plates. Hence, the user does not notice the shrinkage of the mat 4 and enjoys the benefit of the enhanced mat/base plate appearance caused by use of the base plate of this invention.

In other words, the mat is surrounded by a plurality of the horizontal lines parallel to the peiphery of the mat base plate. Thus, it is questioned how may lines are covered by the mat when shrinkage and mat manufacturing dimensional errors are taken into consideration. However, people usually do not count the numbers of the lines but only note that there are a plurality of the step lines. Therefore, even when the number of the lines are changed by several lines one usually would not distinguish the shrinkage and the dimension error of the mat.

Although the mat 4 is only shown as a mat having pile fibers on its upper surface, it is secured with velcro fastener hooks or equivalent, which are then engaged with velcro fastener fleece or the like affixed on the base plate 1 so as to obtain a firm fit.

The mat plate provides an aesthetic appearance even when the mat is shrunk or finished in variety sizes with dimension errors, since the plate comprises a plurality of the steps from the apical ridge down both slopes, and there is no gap around the mat.

Now, the second embodiment will be discussed with reference to FIGS. 7–13. This embodiment discloses that the plate 21 has an inner arcuate slant slope 22*a* on which a plurality of grooves 27*a*–27*d*, and 26*a*–26*b* or ridges 29*a*, 29*b*, 20*a*–20*d* are provided.

Figure 8:
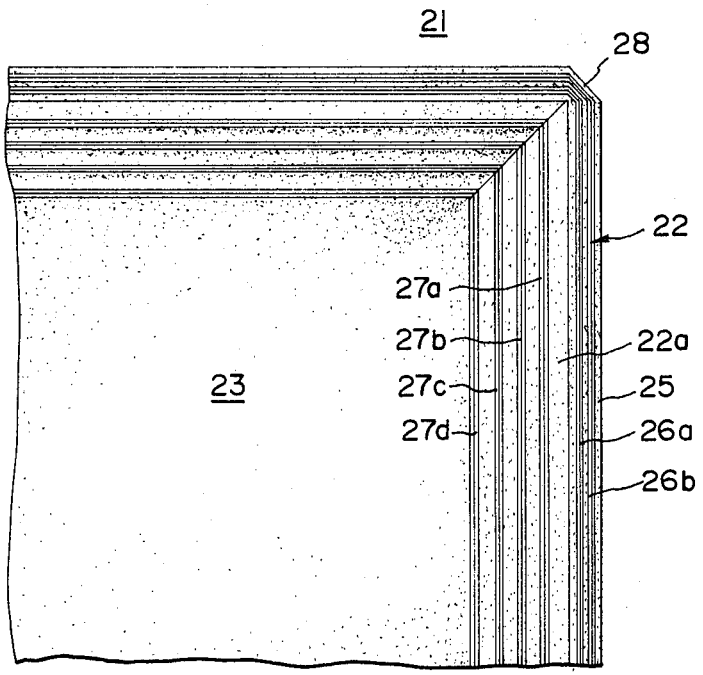
FIG. 8 is a plan view of a partially enlarged plan view.

As shown in FIG. 8, the plate 21 has a rim periphery on which there is an apical ridge 25 which is flat and which is provided with concentric grooves 6*a*, 6*b* parallel to the outer peripheral edge of the mat 4. Inwardly of the rim 22 is an arcuate slant slope 22*a* contiguous to the basin 3. Provided on said slant slope are concentric annular grooves 27*a*–27*d* parallel to the annular grooves 26*a*, 26*b*. As shown in FIG. 8, each corner of the plate is chamfered similar to the first embodiment.

Figure 12:
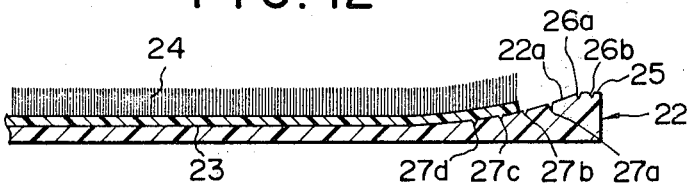
FIGS. 12 and 13 are cross sectional views showing how the plate may be used in combination with a door mat.
Figure 13:
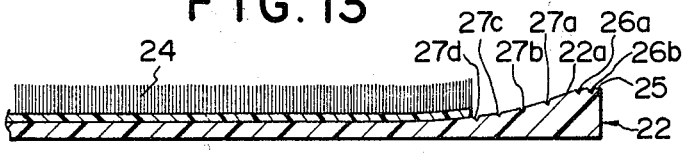
Figure 14:
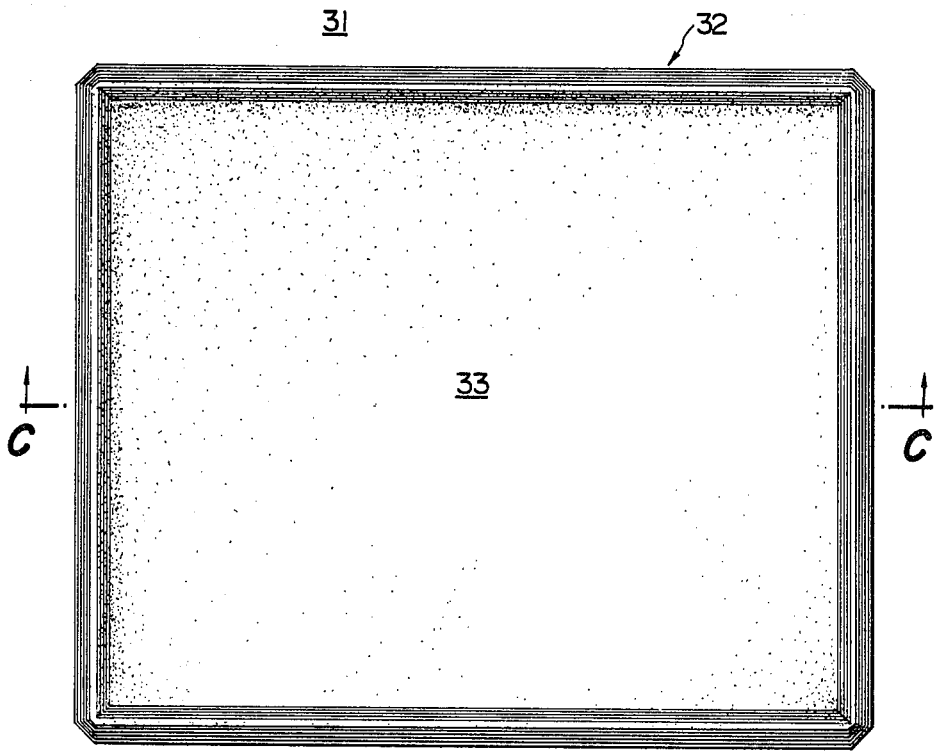
FIG. 14 is a plan view of a third embodiment of this invention.
Figure 16:
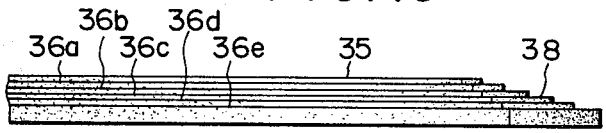
FIG. 16 is a partial enlarged side view.
Figure 17:
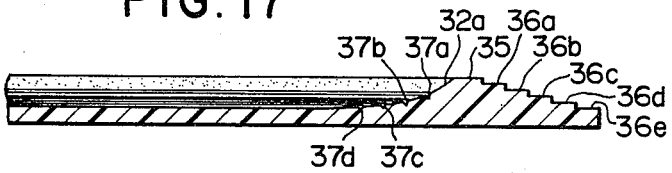
FIG. 17 is a partial enlarged cross section taken along line C—C in FIG. 14.
Figure 18:
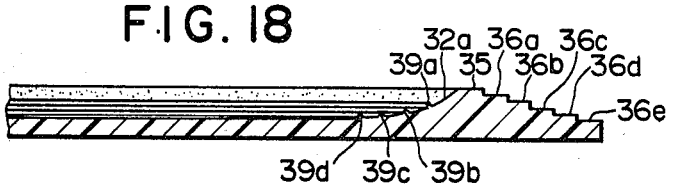
FIG. 18 is an enlarged cross section showing a modification of the third embodiment.
Figure 15:
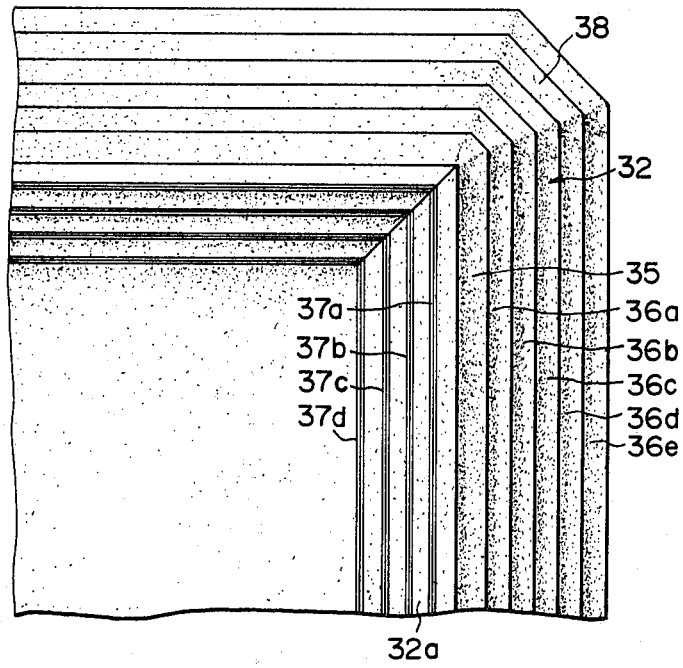
FIG. 15 is a partial enlarged plan view.
Figure 19:
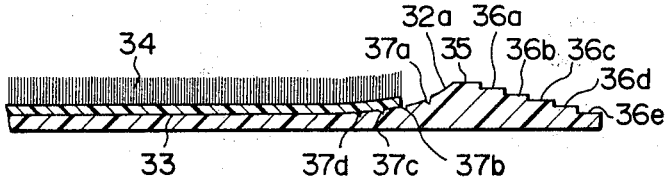
FIGS. 19 and 20 are cross sectional views showing how the plate may be used in combination with a door mat.
Figure 20:
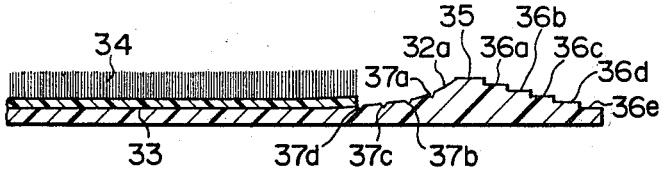

The arcuate slant slope may of course be straight slant slope i.e. with each step having the same tread and rise. Similar to the first embodiment, the mat is placed on the plate with its outer border on the innerside of the lowest groove 27*b* as shown in FIG. 12. The mat rests at a position lower than the ridge 25. There is no risk that a person will trip on an edge of the mat.

After the mat has been washed, the thus-shrunken mat is then placed on the plate so that its outer edge is bordered by the lowest groove 27*d*. As the mat is surrounded by the grooves and ridges, the person only sees the aesthetic arrangement of the plate on which the mat is placed, and usually does not notice the number of bordering lines for the same reason as in the first embodiment.

The third embodiment is a combination of the first and the second embodiments, in which a plurality of descending steps 36*a*–36*e* are provided on the outerside of the apical ridge 35 while on the innerside of the ridge there are provided a plurality of grooves 37*a*–37*d* on ridges 36*a*, 36*b* on a slant slope 32*a*. The mat outer edge region then rests on an intermediate or lower groove 37*d* or rests on the lower portion of the slope, for example at 37*b*.

With this third embodiment, the viewer looks at the mat base plate aesthetically and does not notice any shrinkage or dimension error. The slope 32*a* may be a straight slope or an arcuate slant slope.

What is claimed is:

1. For underlying and bordering a door mat, a mat base plate, comprising:

a generally flat plate portion having an upwardly-presented floor; and a rim perimetrically surrounding said flat plate portion, said rim having an apical ridge lying above said floor;

said rim further including an inner slope portion extending downwardly and inwardly from said apical ridge to said floor;

means defining a plurality of substantial generally concentric frame-like surface disontinuities arranged in a series on said inner slope portion, so that when a door mat with the same general shape in plan as said floor, but a larger size than said floor and a smaller size than said apical ridge, is placed on said mat base plate, it will be noticeably framed at least by said apical ridge and, depending on its size, by part of said inner slope portion preferably including at least one of said frame-like surface discontinuities.

2. The mat base plate of claim 1, wherein:

said inner slope portion is of substantially constant slope from said apical ridge to said floor.

3. The mat base plate of claim 1, wherein:

said inner slope portion is of concave slope from said apical ridge to said floor.

4. The mat base plate of claim 1, wherein:

said concentric frame-like surface discontinuities are provided by a series of steps.

5. The mat base plate of claim 1, wherein:

said concentric frame-like surface discontinuities are provided by a series of ridges.

6. The mat base plate of claim 1, wherein:

said concentric frame-like surface discontinuities are provided by a series of grooves.

7. The mat base plate of claim 1, wherein:

said rim further includes an outer slope portion extending downwardly and outwardly from said apical ridge to the outer extent of said mat base plate.

8. The mat base plate of claim 7, further including:

means defining a plurality of generally concentric frame-like surface discontinuities arranged in a series on said outer slope portion, so that when said door mat is placed on said mat base plate as aforesaid, it will be additionally framed by said outer slope portion including said frame-like surface discontinuities thereof.

9. The mat base plate of claim 8, wherein:

said outer slope portion is of substantially constant slope from the apical ridge to said outer extent of said mat base plate.

10. The mat base plate of claim 8, wherein:

said concentric frame-like surface discontinuities of said outer slope portion are provided by a series of steps.

11. The mat base plate of claim 8, wherein:

said concentric frame-like surface discontinuities on said outer slope portion are provided by a series of ridges.

12. The mat base plate of claim 8, wherein:

said concentric frame-like surface discontinuities on said outer slope portion are provided by a series of grooves.

13. The mat base plate of claim 1, wherein:

said flat plate portion is generally rectangular.

14. The mat base plate of claim 13, wherein:

said apical ridge has four chamfered outer corners.

15. The mat base plate of claim 8, wherein:

said flat plate portion is generally rectangular and said outer slope portion has four chamfered outer corners.

16. The mat base plate of claim 15, wherein:

said apical ridge has four chamfered outer corners.

17. For use in conjunction with a generally rectangular rug-like door mat made of a material which upon being repeatedly washed undergoes shrinkage in perimeter so as to become shorter and narrower than it had originally been, a door mat base plate comprising:

a generally flat plate portion having an upwardly-presented floor; and a rim perimetrically surrounding said flat plate portion, said rim having an apical ridge lying above said floor;

said rim further including an inner slope portion extending downwardly and inwardly from said apical ridge to said floor;

means defining a plurality of substantial, generally concentric frame-like surface discontinuities arranged in a series on said inner slope portion;

each of said frame-like surface discontinuities being of substantially the same shape as the perimeter of the rug-like door mat and at least a majority of said frame-like surface discontinuities being shorter and narrower than the original length and width of the rug-like door mat, so that when the door mat is originally placed on said mat base plate, it will be noticeably framed by said apical ridge and, depending on its size, by part of said inner slop portion preferably including at least one of said frame-like surface discontinuities;

said frame-like surface discontinuities, proceeding from larger to smaller in said series, being progressively shorter and narrower than their predecessors in substantially the same proportion that the rug-like door mat becomes shorter and narrower upon being repeatedly washed, so that, in use, as the rug-like door mat progressively shrinks, it becomes framed by an increasing plurality of said frame-like surface discontinuities.

* * * * *